US005889496A

United States Patent [19]

Maas

[11] Patent Number: 5,889,496

[45] Date of Patent: Mar. 30, 1999

[54] CONSOLIDATED SYSTEM OF ANTENNAS

[76] Inventor: Corey Maas, 130 Curry Ave., Sausalito, Calif. 94965

[21] Appl. No.: 831,062

[22] Filed: Apr. 1, 1997

[51] Int. Cl.[6] ..... H01Q 9/04

[52] U.S. Cl. ..... 343/791; 343/715; 343/792; 343/722; 343/903; 343/853; 343/893; 343/787; 343/788

[58] Field of Search ..... 343/715, 903, 343/792, 722, 791; 342/357; 455/345

[56] References Cited

U.S. PATENT DOCUMENTS 5,189,435 2/1993 Yarsunas ..... 343/903
5,345,247 9/1994 Aldama et al. ..... 343/791
5,523,761 6/1996 Gildea ..... 342/357

*Primary Examiner*—Robert H. Kim
*Assistant Examiner*—Layla G. Lauchman
*Attorney, Agent, or Firm*—Pretty, Schroeder & Poplawski

[57] ABSTRACT

A system of antennas for conserving space and concealing the separate identity of the individual antennas. The antennas may be a radio antenna and a telecommunications antenna. The antennas may have a common base to eliminate separate wires and holes in the vehicle on which they are mounted. The antennas may be housed within the same casing to protect them from the elements and from other harm.

6 Claims, 3 Drawing Sheets

CONSOLIDATED SYSTEM OF ANTENNAS

BRIEF DESCRIPTION OF THE INVENTION

The present invention relates to the consolidation of antennas. More particularly, the present invention relates to the consolidation of radio and telecommunication antennas for motor vehicles.

BACKGROUND OF THE INVENTION

As communication technology advances, more methods of communication become available to consumers. Miniaturization of electronic components for communication methods have made it theoretically possible to have portable cellular telephones. Accompanying this miniaturization has been a reduction in the cost of the systems using these components. This cost reduction has brought the theory to reality, enabling a large number of consumers to afford cutting-edge telecommunication technology, for example, cellular telephones.

Miniaturization and cost reduction have opened up the possibilities for affordable mobile communications. It is now quite common for consumers to have cellular telephones in their vehicles. New mobile communication proposals yet to become readily available to the public include global positioning, obstacle detection systems and collision avoidance systems. Still others have yet to be imagined by even the most inventive minds. Inherent in all of the current, proposed, and yet to be imagined amenities is the need for mobile communication systems to transmit and/or receive information from remote locations to the consumer's vehicles without hard-wire connections. In other words, these systems do or will require antennas on the consumers' vehicles.

The availability of these technological advantages comes, however, with some drawbacks. For example, the antennas for these systems must compete for space on the vehicle. Often, antennas must be separated from obstacles to avoid disruption of their antenna patterns. On motor vehicles, therefore, telecommunication antennas must compete with the other antennas on the vehicle. Currently, cellular phone antennas and radio (i.e., AM/FM) antennas are separated spatially on the vehicle's surface. This spatial separation mandates separate electrical wiring to transmit and receive information via the antennas. Wiring to separate locations requires additional labor and increases the cost of the multiple locations versus a consolidated unit. Moreover, the distinct antenna locations require multiple mountings on the vehicle's surface. This also increases the cost of the system over a consolidated unit and requires multiple holes to be put in the vehicle's surface. One could reduce the need for a cellular phone antenna on the vehicle's surface by using a handheld unit with its own antenna. This arrangement, however, has its own deficiencies. First, according to the TIA/ELA Interim Standard IS-88 (Telecommunications Industry Association 1993), handheld units are limited to transmitting 0.6 watts while a cellular phone mounted on the vehicle's surface, remote from the operator is allowed to transmit three (3) watts (although higher powers may be possible depending on the type of telecommunication antenna used). The added power output of a surface-mounted antenna increases the range and, generally, the communication clarity available. Second, the operator may not have the option of using anything other than a surface-mounted antenna for future telecommunication purposes or systems.

Furthermore, vehicle owners often do not want passersby to know that the vehicle contains a cellular phone, or other variety of telecommunication equipment. Passersby can readily identify cars containing cellular phones due to the distinctive cellular antenna. As not every vehicle has a cellular phone, and usually those that do have other expensive items therein, vehicles with cellular phones may be the target of thieves seeking the phones themselves, or other items likely to be found in vehicles containing cellular phones. This may also apply to other forms of telecommunication and their respective antennas.

Owners therefore would often like to conceal the fact that a vehicle contains a cellular phone or other form of telecommunication.

Thus, the need currently exists for a consolidated antenna system to: reduce the cost of multiple antennas on a vehicle; allow increased transmit power from a cellular telephone antenna or other form of telecommunication antenna; conceal the fact that a vehicle has a telecommunication device therein; and/or reduce the number of holes needed in the vehicle's exterior. The present invention satisfies these needs with a consolidated antenna system that reduces system cost, wiring, and mounting holes while maintaining the advantages of remote surface-mounted telecommunication antennas.

SUMMARY OF INVENTION

The present invention solves the problems and provides the advantages described above.

Briefly, the present invention comprises a system of antennas comprising a first antenna adapted to receive electromagnetic signals in a first frequency range, and a second antenna adapted to receive electromagnetic signals in a second frequency range. These first and second antennas may be a radio antenna and a telecommunication antenna. They may share a common longitudinal axis. The antenna system of the present invention will likely have a common mounting apparatus. In particular, the antenna system may have a common base on which the antennas are disposed. Moreover, the antenna system of the present invention may have a common radome for the antennas, providing protection from the environment and concealing the fact that a telecommunication antenna is present.

DETAILED DESCRIPTION OF THE DRAWINGS

Figure 1:
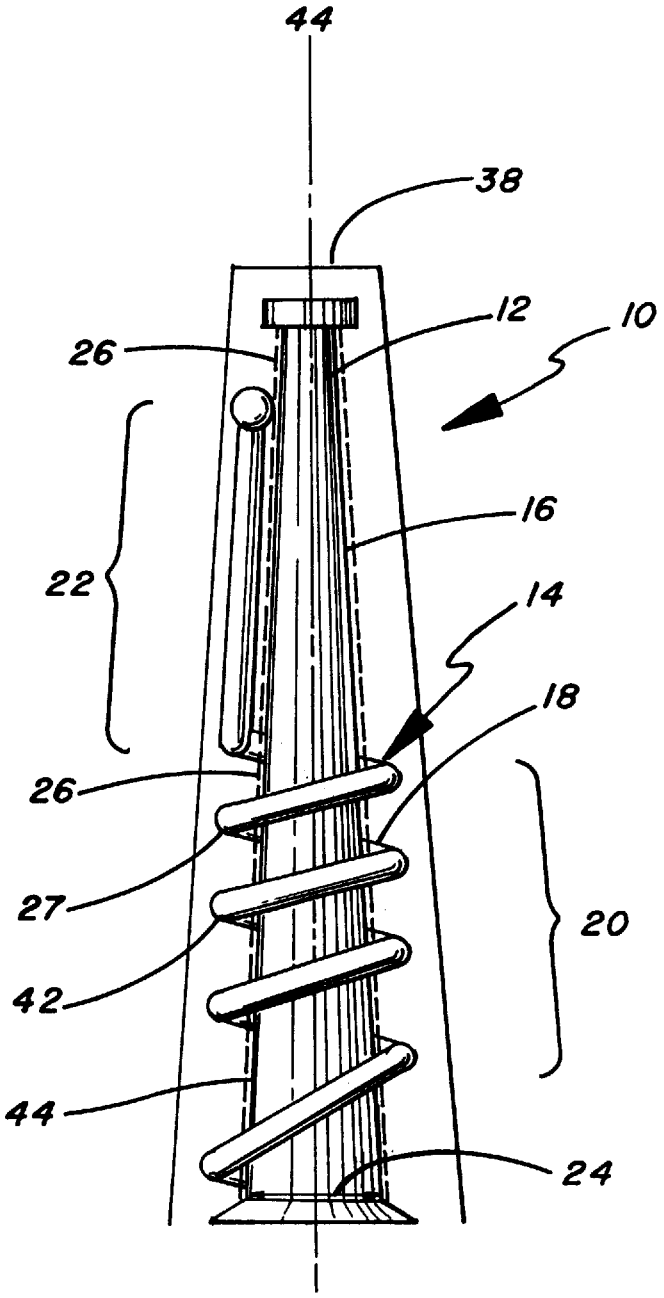
FIG. 1 shows a preferred embodiment of the present invention with a cellular antenna disposed about a peripheral region of a radio antenna.

FIG. 1 shows a preferred embodiment of the present invention. An antenna system 10 comprises a first antenna 12 and a second antenna 14. First antenna 12 and second antenna 14 are adapted to transmit/receive electromagnetic energy in first and second frequency ranges respectively. In FIG. 1 first antenna 12 comprises a standard AM/FM radio antenna and second antenna 14 comprises a cellular telephone antenna. These antennas need not comprise a radio antenna or a cellular telephone antenna. The present invention encompasses the use of other forms of antennas. Second antenna 14 could be another form of a telecommunication antenna. Either antenna could comprise a helix, patch, flared notch, waveguide fed, or other form of antenna known or to be invented which may be used as an obstacle-avoidance/detection antenna, distance detecting antenna, or for a use not mentioned or not even invented yet, without going beyond the scope of the present invention.

First antenna 12, even when comprising a radio antenna, may take several forms. A person employing the present invention may use a standard AM/FM antenna that is well known in the industry. Alternatively, one may use a modified AM/FM antenna adapted to be mounted with the particular form of second antenna 14 desired. First antenna 12 may be either of the fixed length or retractable variety.

Second antenna 14, even when comprising a telecommunication antenna, may also take various forms. Second antenna 14 may be any current or future telecommunication antenna including a cellular antenna (i.e., an antenna used with cellular telephones) as shown in FIG. 1. As shown in FIG. 1, telecommunication antenna 14 is the standard cellular telephone antenna as is well known in the industry, comprising a helical bottom portion 20 and a monopole top portion 22. Alternatively, a modified antenna comprising a helical bottom portion 20 comprising a larger diameter 24 than that of a standard cellular antenna may be necessary.

In the embodiment shown in FIG. 1, second antenna 14 is disposed about a peripheral region 16 of first antenna 12. Both antennas 12 and 14 are disposed about a common longitudinal axis 44. To help isolate the two antennas 12 and 14 electromagnetically, an insulative barrier 18 is disposed between first antenna 12 and second antenna 14. The insulator 18 may be air, or another insulating material. An insulating material other than air is required if the antennas 12 and 14 are to be mechanically coupled. An electromagnetically insulative coating 26, on an outside surface 41 of first antenna 12, and/or an electromagnetically insulative coating 27, on an outside surface 42 of second antenna 14, may be used to help electromagnetically isolate first antenna 12 from second antenna 14.

Antenna system 10 may also have a radome 38 adapted to allow transmission of electromagnetic energy in first and second frequency ranges while protecting the antennas 12 and 14 from the environment. The radome 38 may be opaque, which would conceal the presence of the antennas 12 and 14.

Figure 2:
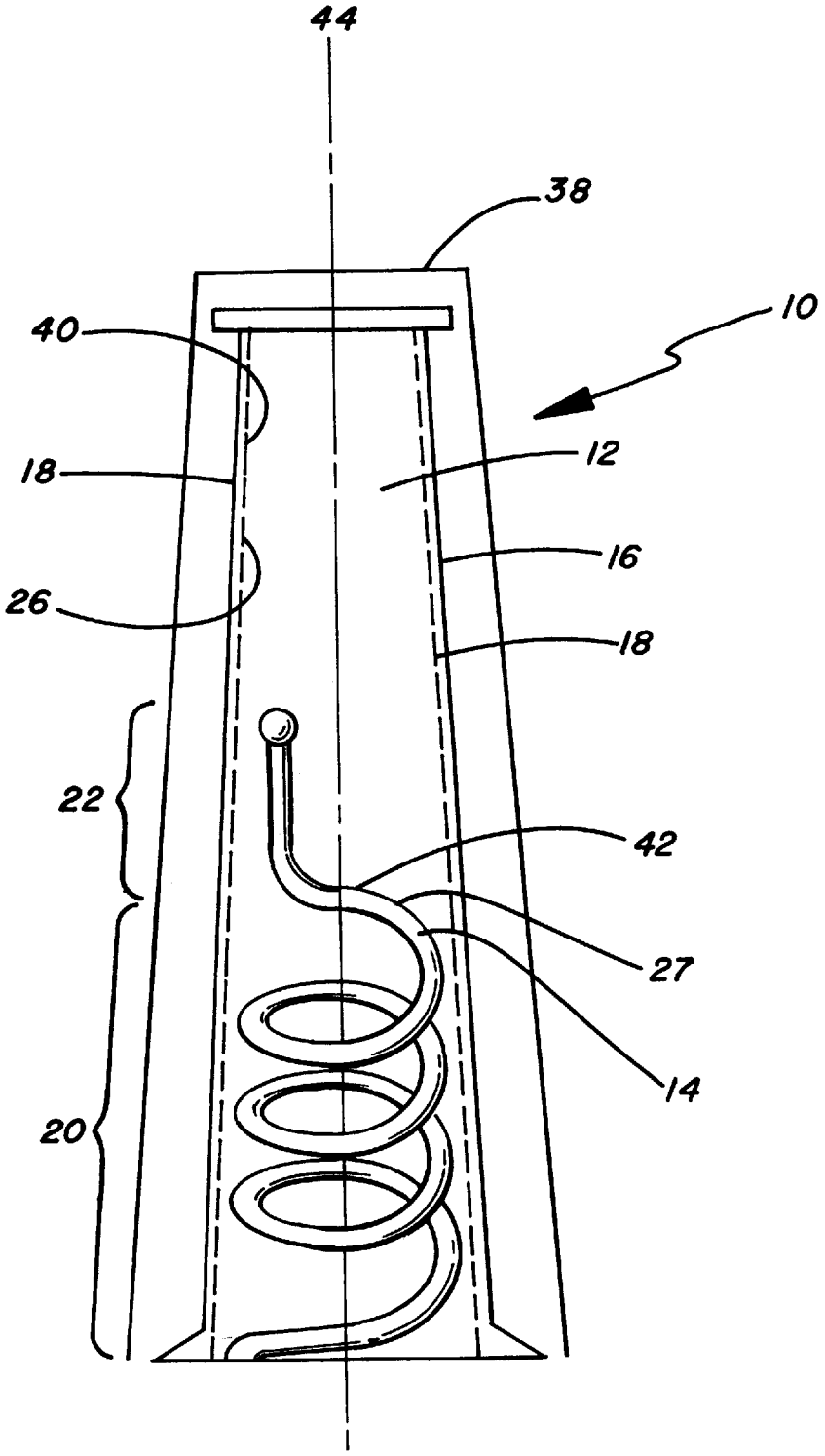
FIG. 2 shows a preferred embodiment of the present invention with a cellular antenna disposed within a peripheral region of a radio antenna.

FIG. 2 shows another preferred embodiment of the present invention. In this embodiment, the second antenna 14, again shown as a cellular antenna, is disposed within the periphery 16 of the first antenna 12. Both antennas 12 and 14 are disposed about a common longitudinal axis 44. First antenna 12 is modified from the standard solid metal periphery 16 known in the industry to allow electromagnetic energy in at least the frequency band of the second antenna 14 to pass through the periphery 16. For example, first antenna 12 may comprise a plurality of strips of metal. The strips of metal could be in various configurations including, but not limited to, vertical strips, horizontal strips, spiraling strips, or combinations thereof. As with the embodiment of FIG. 1, insulator 18 may be disposed between first and second antennas 12 and 14. Insulator 18 would comprise electromagnetically insulative material to permit electrical operation of the antennas 12 and 14 while helping to electromagnetically isolate them. An insulative coating 26 may be put on an inside surface 40 of first antenna 12 or an insulative coating 27 may be put on the outside surface 42 of second antenna 14. Combinations of insulators 18, 26, and 27 may also be used.

As with the configuration of FIG. 1, the configuration of FIG. 2 may also have a radome 38 adapted to allow transmission of electromagnetic energy of the frequencies used by antennas 12 and 14 while protecting the antennas 12 and 14 from the environment. Again, the radome 38 may be opaque, which would conceal the presence of the antennas 12 and 14.

Figure 3:
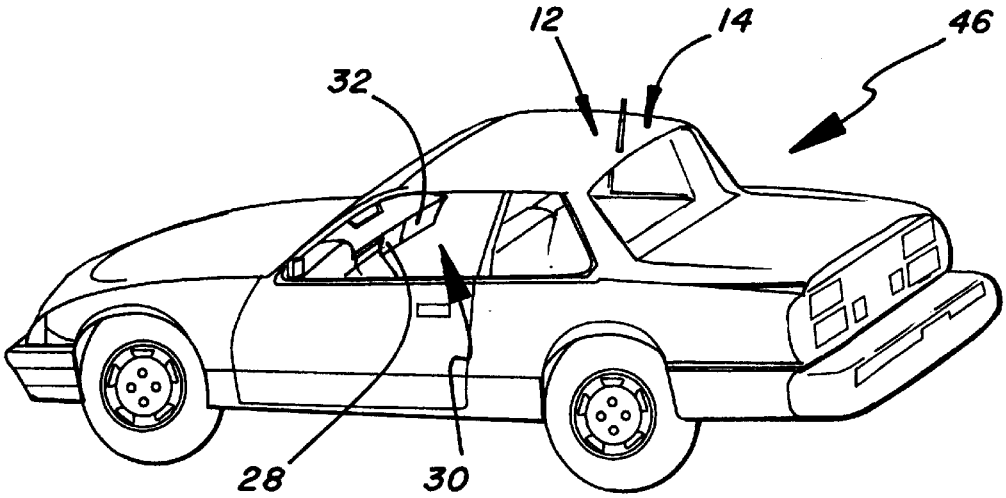
FIG. 3 shows the present invention used in conjunction with a motor vehicle.

Referring to FIG. 3, first antenna 12 and second antenna 14 are electrically coupled to devices adapted to receive and/or transmit electromagnetic energy in first and second frequency ranges respectively. In a preferred embodiment, first antenna 12 is coupled to a radio 28 and second antenna 14 is coupled to a telecommunication interface 30 (e.g., a cellular telephone), of a motor vehicle 46. As shown in FIG. 3, motor vehicle 46 is a car. Motor vehicle 46 is not limited to cars. Motor vehicle 46 includes, but is not limited to, cars, trucks, motorcycles, and boats. Telecommunication interface 30 also may take several forms including, but not limited to, a telephone for use with a cellular antenna or a portable telephone. Instead of or in addition to coupling to telecommunication interface 30, either or both first antenna 12 and second antenna 14 may be electrically coupled to a console 32 (i.e., a dashboard) of motor vehicle 46. Console 32 may be adapted to receive connections to radios, including portable radios, telephones, including portable telephones, or other devices. First and second antennas 12 and 14 may also be coupled to any other device to which they are adapted to couple. These other devices include, but are not limited to, radar systems for such uses as distance detection, monitoring, and adjusting, and obstacle avoidance. Other couplings not mentioned, or even not invented yet, also fall within the scope of the present invention.

Figure 4:
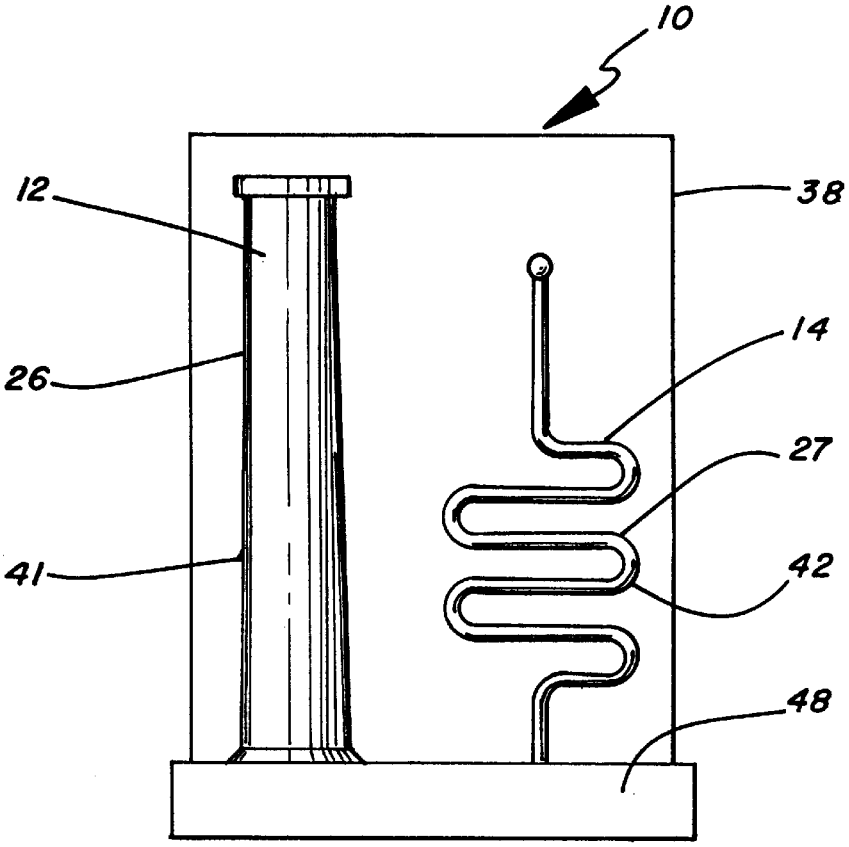
FIG. 4 shows a preferred embodiment of the present invention with a cellular antenna and a radio antenna coupled to a common base.

FIG. 4 shows a second preferred embodiment of the present invention. Antenna system 10 comprises a first antenna 12 and a second antenna 14 coupled to a base 48. As in FIG. 1, first antenna 12 comprises a standard AM/FM radio antenna and second antenna 14 comprises a cellular telephone antenna. Base 48 is adapted to be mechanically coupled to a motor vehicle. An electromagnetically insulative coating 26, on an outside surface 41 of first antenna 12, and/or an electromagnetically insulative coating 27, on an outside surface 42 of second antenna 14, may be used to help electromagnetically isolate first antenna 12 from second antenna 14.

As with the configurations of FIGS. 1 and 2, the configuration of FIG. 4 may also have a radome 38 adapted to allow transmission of electromagnetic energy of the frequencies used by antennas 12 and 14 while protecting the antennas 12 and 14 from the environment. Again, the radome 38 may be opaque, which would conceal the presence of the antennas 12 and 14.

The preceding description serves as a guide for a skilled artisan to make and use the present invention, but should not be interpreted as an exhaustive, all-inclusive description of the invention. One skilled in the art can certainly make many variations of the present invention without deviating from the novelty and spirit of the invention disclosed. In particular, telecommunication antennas, both presently existing and those yet to be invented, other than cellular antennas are within the scope of the present invention. Consequently, the present invention includes all equivalencies of the invention described herein. The reader should bear these equivalencies in mind when interpreting the scope of the following claims.

I claim:

1. A system antennas for use with a motor vehicle, said system comprising:

a radio antenna, adapted to receive AM and FM radio transmission signals, adapted to be coupled to said motor vehicle; and a telecommunication antenna, disposed along a common longitudinal axis with said radio antenna and about a peripheral region of said radio antenna, adapted to transmit and receive telephonic communication signals, and adapted to be coupled to said motor vehicle.

2. A system of antennas for use with a motor vehicle, said system comprising:

a radio antenna, adapted to receive AM and FM radio transmission signals, adapted to be coupled to said motor vehicle;

a telecommunication antenna, disposed along a common longitudinal axis with said radio antenna, adapted to receive communication signals, and adapted to be coupled to said motor vehicle; and a radome, disposed about a peripheral region of said radio antenna and said telecommunication antenna, adapted to allow transmission of electromagnetic energy of frequencies used by said radio antenna and said telecommunication antenna.

3. The antenna system of claim 2 wherein said radome is opaque.

4. A system of antennas for use with a motor vehicle, said system comprising:

a radio antenna, adapted to receive AM and FM radio transmission signals, mechanically coupled to said motor vehicle and adapted to be electrically coupled to a radio adapted to be coupled to said motor vehicle; and a telecommunication antenna, disposed along a common axis with said radio antenna and further disposed about a peripheral region of said radio antenna, adapted to receive and transmit telephonic communication signals, said telecommunication antenna mechanically coupled to said motor vehicle and adapted to be electrically coupled to a telephone adapted to be coupled to said motor vehicle.

5. A system of antennas for use with a motor vehicle, said system comprising:

a radio antenna, adapted to receive AM and FM radio transmission signals, mechanically coupled to said motor vehicle and adapted to be electrically coupled to a radio adapted to be coupled to said motor vehicle;

a telecommunication antenna, disposed along a common axis with said radio antenna and further disposed about a peripheral region of said radio antenna, adapted to receive and transmit telephonic communication signals, said telecommunication antenna mechanically coupled to said motor vehicle and adapted to be electrically coupled to a telephone adapted to be coupled to said motor vehicle; and a radome, disposed about a periphery of said radio antenna and said telecommunication antenna, adapted to allow transmission of electromagnetic energy of frequencies used by said radio antenna and said telecommunication antenna.

6. The antenna system of claim 5 wherein said randome is opaque.

* * * * *